US006536986B1

(12) United States Patent
Anghileri et al.

(10) Patent No.: US 6,536,986 B1
(45) Date of Patent: Mar. 25, 2003

(54) ENERGY ABSORPTION APPARATUS WITH COLLAPSIBLE MODULES

(75) Inventors: Marco Anghileri, Milan (IT); Franz M. Muller, Milan (IT); Owen S. Denman, Sacramento, CA (US)

(73) Assignee: Barrier Systems, Inc., Rio Vista, CA (US)

( * ) Notice: Subject to any disclaimer, the term of this patent is extended or adjusted under 35 U.S.C. 154(b) by 0 days.

(21) Appl. No.: 09/961,584

(22) Filed: Sep. 24, 2001

(51) Int. Cl.[7] ..... E01F 15/00
(52) U.S. Cl. ..... 404/6; 404/10
(58) Field of Search ..... 404/6, 9, 10; 256/13.1

(56) References Cited

U.S. PATENT DOCUMENTS

| | | | | |
|---|---|---|---|---|
| 3,643,924 A | | 2/1972 | Fitch | |
| 3,695,583 A | | 10/1972 | Walker et al. | |
| 3,768,781 A | | 10/1973 | Walker et al. | |
| 3,944,187 A | * | 3/1976 | Walker | 188/377 |
| 3,982,734 A | * | 9/1976 | Walker | 256/13.1 |
| 4,009,622 A | | 3/1977 | Hinderks | |
| 4,101,115 A | * | 7/1978 | Meinzer | 188/377 |
| 4,138,093 A | * | 2/1979 | Meinzer | 188/377 |
| 4,321,989 A | * | 3/1982 | Meinzer | 188/377 |
| 4,399,980 A | * | 8/1983 | van Schie | 188/377 |
| 4,452,431 A | | 6/1984 | Stephens et al. | |
| 4,645,375 A | * | 2/1987 | Carney, III | 188/377 |
| 4,674,911 A | | 6/1987 | Gertz | |
| 4,688,766 A | * | 8/1987 | Zucker | 256/13.1 |
| 4,815,565 A | | 3/1989 | Sicking et al. | |
| 4,844,213 A | | 7/1989 | Travis | |
| 4,934,661 A | * | 6/1990 | Denman et al. | 256/1 |
| 5,011,326 A | * | 4/1991 | Carney, III | 404/6 |
| 5,020,175 A | | 6/1991 | Kirkpatrick et al. | |
| 5,112,028 A | * | 5/1992 | Laturner | 248/66 |
| 5,192,157 A | * | 3/1993 | Laturner | 256/13.1 |
| 5,391,016 A | | 2/1995 | Ivey et al. | |
| 5,660,496 A | | 8/1997 | Muller et al. | |
| 5,746,419 A | | 5/1998 | McFadden et al. | |
| 5,851,005 A | | 12/1998 | Muller et al. | |
| 6,085,878 A | | 7/2000 | Araki et al. | |
| 6,116,805 A | * | 9/2000 | Gertz | 256/13.1 |
| 6,203,079 B1 | | 3/2001 | Breed | |

FOREIGN PATENT DOCUMENTS

WO 02/18816 * 3/2002

* cited by examiner

*Primary Examiner*—Gary S. Hartmann
(74) *Attorney, Agent, or Firm*—Thomas R. Lampe

(57) ABSTRACT

Apparatus for absorbing energy when impacted by a vehicle includes a plurality of vertical, spaced supports. Positioned between the supports are energy absorbing, collapsible, pressurizable modules having two connected module segments. Each module segment has an outer wall in the form of a truncated cone extending away from an end of the energy absorbing module and diverging outwardly in the direction of the other module segment.

23 Claims, 5 Drawing Sheets

ENERGY ABSORPTION APPARATUS WITH COLLAPSIBLE MODULES

TECHNICAL FIELD

This invention relates to apparatus for absorbing energy when impacted by a vehicle. More specifically, the apparatus is utilized as a barrier which dissipates the energy of moving vehicles upon impact to reduce injury to the vehicle's occupants and damage to structure protected by the barrier apparatus.

BACKGROUND OF THE INVENTION

It is well known to provide impact absorbing systems, often called "crash cushions" adjacent to rigid structures such as pillars, bridge abutments, lighting poles and the like for the purpose of absorbing vehicle impact energy and minimizing the effects of impact on the vehicle, the vehicle's occupants and the structure being protected.

There are many forms and types of energy absorption barriers.

U.S. Pat. No. 5,851,005, issued Dec. 22, 1998, discloses an energy absorption apparatus in the form of a modular energy absorption barrier assembly including multiple pairs of ground engaging support uprights interconnected to one another by overlapping side panels. The side panels and uprights are connected together by inter-engaging slides so that an impact at the end of the barrier assembly can cause relative movement between the uprights, between the side panels, and between the uprights and the side panels.

Located between the uprights and secured thereto are a plurality of energy absorbing metal plates configured in such a way that they collapse in a controlled manner upon vehicle impact to absorb impact forces.

As will be seen below, the invention disclosed herein utilizes a double-ended energy absorbing module including two attached module segments, each of the module segments having an outer wall in the form of a truncated cone extending away from an end of the energy absorbing module and diverging outwardly in the direction of the other module segment. The purpose of such configuration is described below.

U.S. Pat. No. 4,009,622, issued Mar. 1, 1977, discloses a structural member suitable for incorporation in motor vehicles especially as a steering column which incorporates metal truncated cones disposed end to end which incorporate nicks or cuts which can grow to full-scale tears during collapse as the structural member is subjected to an endwise load. All or part of the interior of the column when mounted in a vehicle may be used as a reservoir to contain fire fighting fluid, fluid under pressure which is part of the vehicle's hydraulic system, hot or cold fluid which is part of an engine cooling or air conditioning system or fluid which is part of a vehicle's lubrication or fuel system.

The following patents are also known and are believed to be further representative of the current state of the crash cushion art: U.S. Pat. No. 6,203,079, issued Mar. 20,. 2001, U.S. Pat. No. 3,643,924, issued Feb. 22, 1972, U.S. Pat. No. 3,695,583, issued Oct. 3, 1972, U.S. Pat. No. 3,768,781, issued Oct. 30, 1973, U.S. Pat. No. 5,020,175, issued Jun. 4, 1991, U.S. Pat. No. 5,391,016, issued Feb. 21, 1995, U.S. Pat. No. 5,746,419, issued May 5, 1998, U.S. Pat. No. 6,085,878, issued Jul. 11, 2000, U.S. Pat. No. 4,815,565, issued Mar. 28, 1989, U.S. Pat. No. 6,116,805, issued Sep. 12, 2000, U.S. Pat. No. 4,844,213, issued Jul. 4, 1989, U.S. Pat. No. 4,452,431, issued Jun. 5, 1984, U.S. Pat. No. 4,674,911, issued Jun. 23, 1987, U.S. Pat. No. 5,851,005, issued Dec. 22, 1998, U.S. Pat. No. 5,660,496, issued Aug. 26, 1997, and U.S. Pat. No. 4,009,622, issued Mar. 1, 1977.

DISCLOSURE OF INVENTION

The present invention relates to apparatus for absorbing energy when impacted by a vehicle. The apparatus incorporates energy absorbing modules of a specified structure and configuration which provide for the controlled absorption of impact forces. The energy absorbing modules are relatively inexpensive and may quickly and readily be installed or removed from the rest of the apparatus.

The apparatus includes a plurality of vertical, spaced supports.

A double-ended energy absorbing module is disposed between adjacent supports and is collapsible when a force is applied to an end of the energy absorbing module due to relative movement between the adjacent supports caused by a vehicle impacting the apparatus.

The energy absorbing module defines an interior and includes two attached module segments. Each of the module segments has an outer wall in the form of a truncated cone extending away from an end of the energy absorbing module and diverging outwardly in the direction of the other module segment.

Other features, advantages and objects of the present invention will become apparent with reference to the following description and accompanying drawings.

MODES FOR CARRYING OUT THE INVENTION

Figure 1:
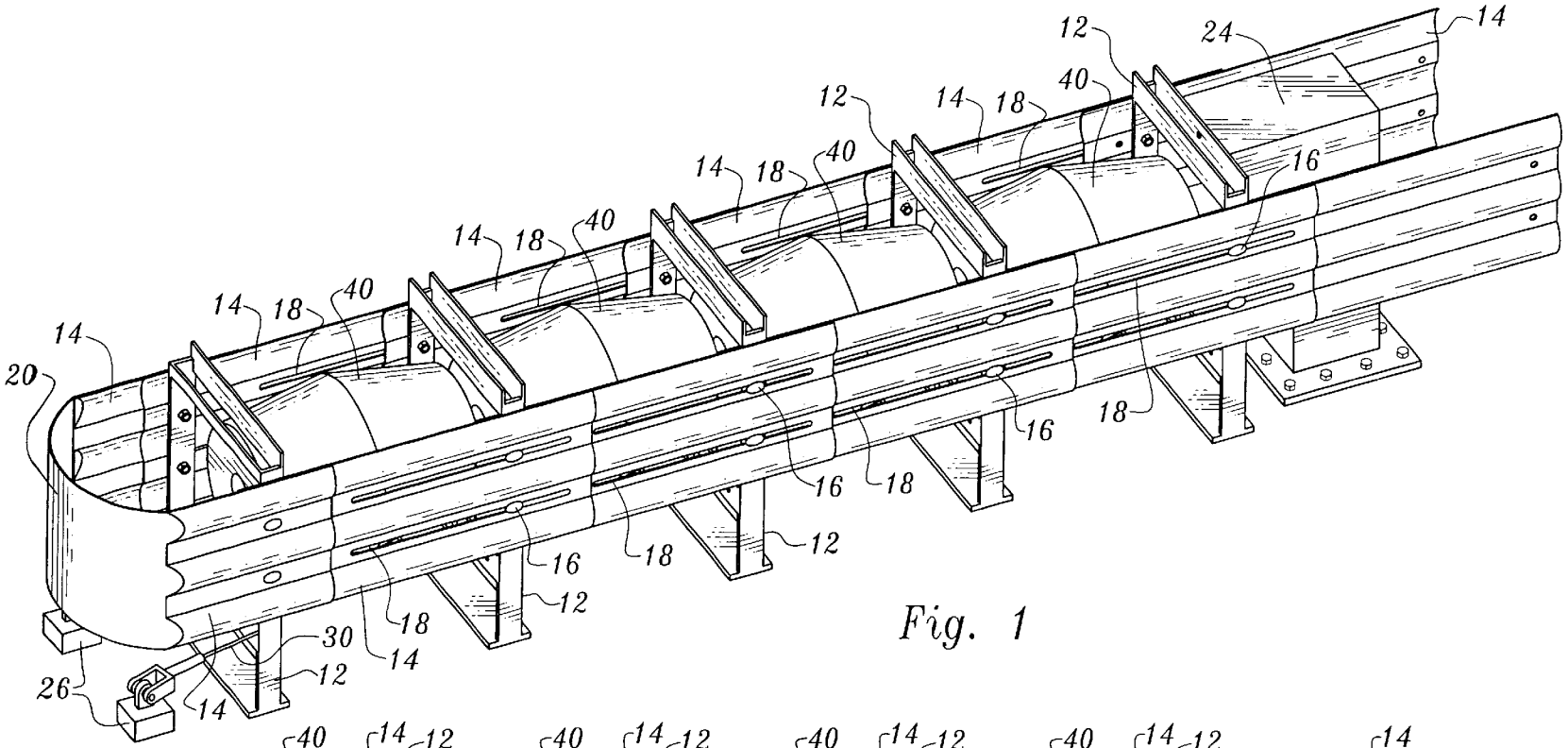
FIG. 1 is a perspective view of barrier apparatus constructed in accordance with the teachings of the present invention and employing a plurality of energy absorbing modules.
Figure 2:
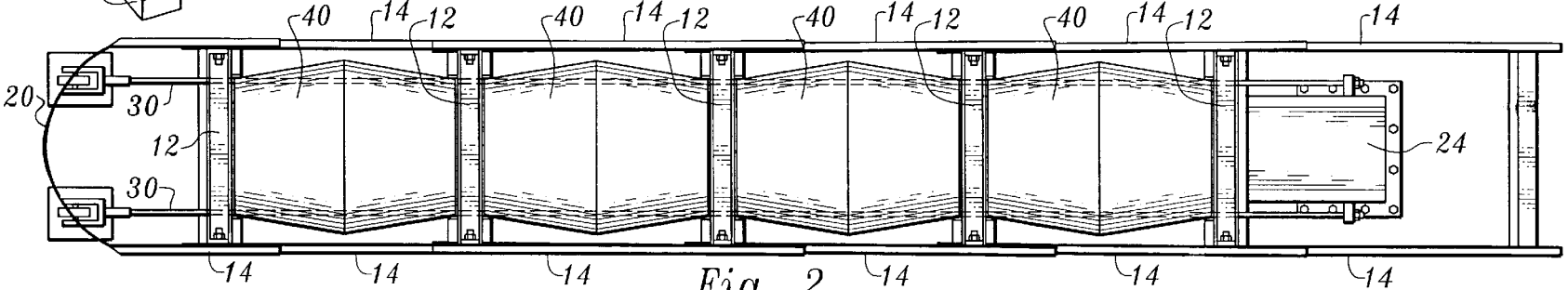
FIG. 2 is a plan view of the barrier apparatus.
Figure 3:
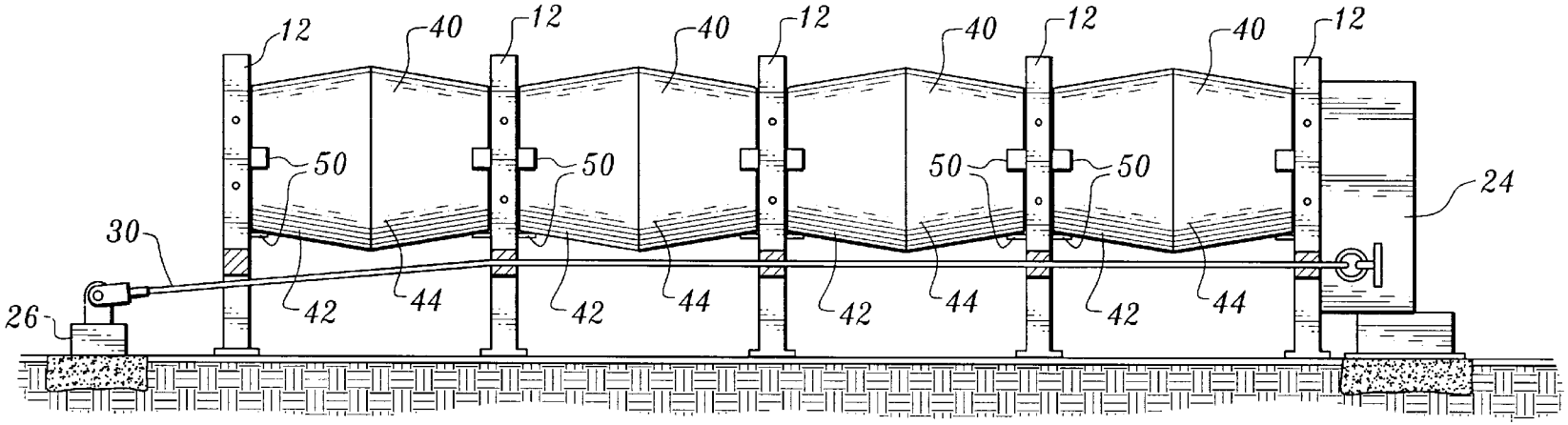
FIG. 3 is a cross-sectional, side, elevational view illustrating selected components of the apparatus, not including apparatus side panels, the illustrated components being in the condition assumed thereby prior to vehicle impact.

Referring now to FIGS. 1–6 and 9, energy absorbing barrier apparatus constructed in accordance with the teachings of the present invention is illustrated. The apparatus includes a plurality of vertical, spaced supports in the form of steel frames 12, such supports engaging the ground and extending upwardly therefrom. The supports or uprights 12 are interconnected to one another by overlapping side panels 14 which may, for example, be corrugated guardrails well known to those skilled in the art. The side panels 14 and the supports 12 are connected together by slides 16 projecting from the supports and positioned in slots 18 extending longitudinally and formed in side panels 14.

A front impact member 20 is secured to a pair of end-most side panels 14. A dead man or anchor 24 is disposed at the other end of the apparatus at the rear of one of the supports 12. The anchor may, for example, be a block of concrete secured to the ground and perhaps partially embedded therein.

Figure 4:
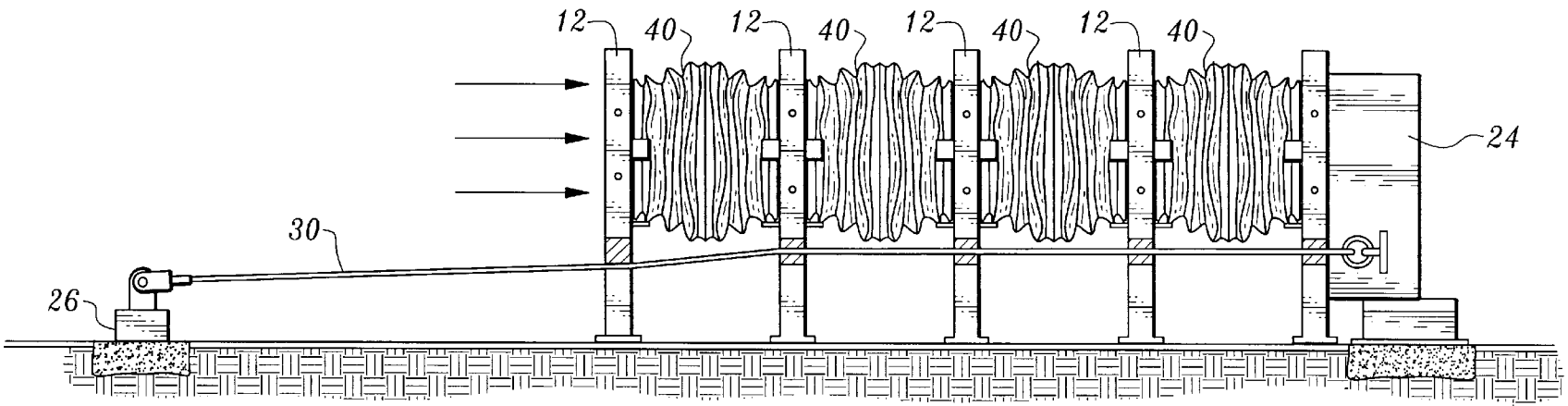
FIG. 4 is a view similar to FIG. 3, but illustrating the condition of the components after vehicle impact.
Figure 5:
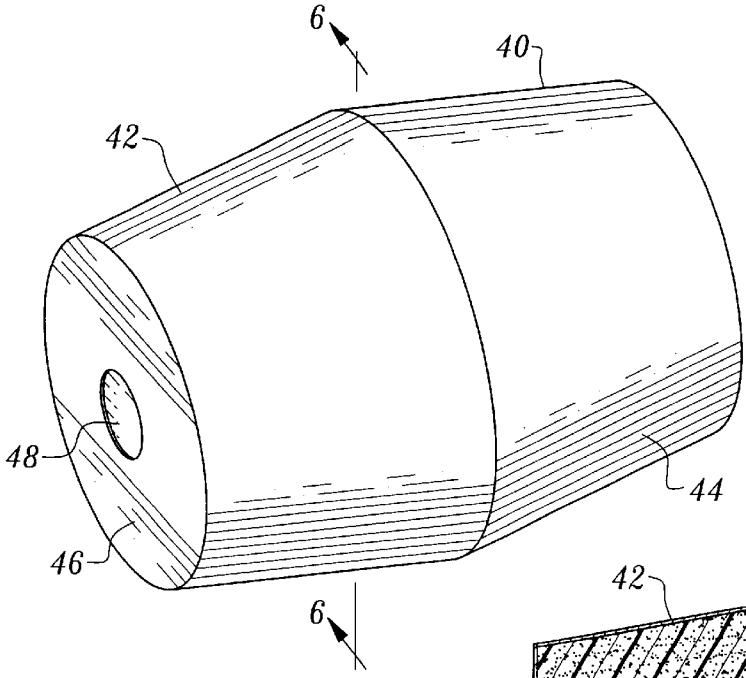
FIG. 5 is a perspective view of an energy absorbing module constructed in accordance with the teachings of the present invention.
Figure 6:
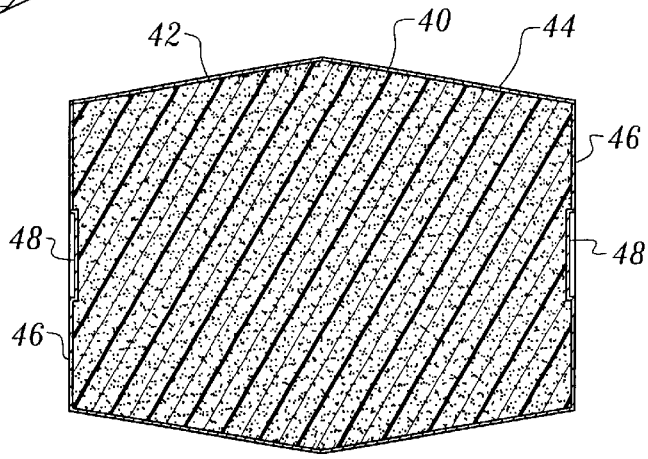
FIG. 6 is a cross-sectional view taken along the line 6—6 in FIG. 5.

Anchor plates 26 are located at the front end of the apparatus and pre-stressed cables 30 extend between the anchor plates 26 and anchor 24, the cables passing through the supports 12. The cables serve to maintain the structural integrity of the apparatus while at the same time providing a trackway or guide providing guided movement of the supports upon impact. This is illustrated in FIG. 4.

Positioned between adjacent supports 12 are double-ended energy absorbing modules 40. The modules 40 include two module segments 42, 44, each of which has an outer wall in the form of a truncated cone extending away from an end of the module and diverging outwardly in the direction of the other module segment. The ends of the energy absorbing module are in the form of end walls 46 of the module segments. The modules are collapsible containers, the module segments defining a pressurizable interior. In the arrangement illustrated, a blow-out plug 48 is located in an air egress opening formed in each of the end walls, the blow-out plugs breaking away from the module segments when sufficient pressure builds up inside the energy absorbing module. However, in accordance with the teachings of the present invention, it is not necessary that blow-out plugs or openings be formed in the energy absorbing modules, unless desired.

Each energy absorbing module is of integral construction, preferably being formed of roto-molded plastic, for example cross linked polyethylene.

It will be seen that the energy absorbing modules 40 are disposed in alignment when installed between the supports, the planar end walls 46 thereof being vertically oriented, parallel and positioned in engagement with, or at least in close proximity to, the supports with which the modules are associated.

Figure 9:
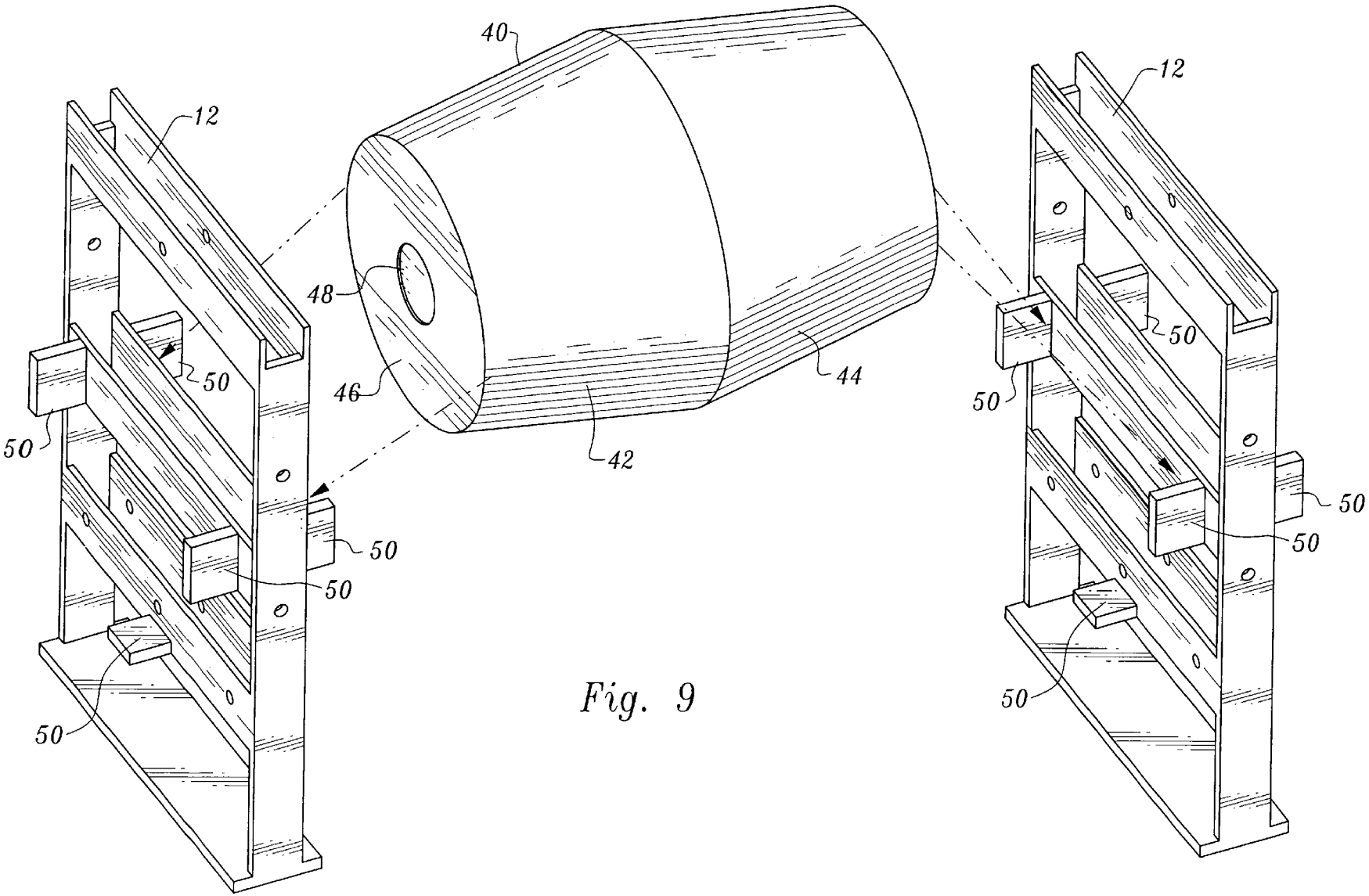
FIG. 9 is an exploded, perspective view illustrating an energy absorbing module and two vertical, spaced supports employed in the apparatus, and showing details of the arrangement for connecting the energy absorbing module to the supports.

Referring now to FIG. 9, projections 50 are formed on the supports, such projections suitably being plates welded or otherwise secured to the supports. In the arrangement illustrated, the energy absorbing modules 40 are connected to the supports by placing the ends of the energy absorbing module over the lowest and horizontally disposed plate 50 to provide support for the energy absorbing module. The upper and vertically disposed plates help to maintain the energy absorbing module in position on the supports.

In the arrangement illustrated in FIGS. 1–6 and 9, the interiors of the energy absorbing modules are filled with a foam, such as a polyurethane foam formed in situ. All, some, or none of the energy absorbing modules may be foam filled to provide the desired characteristics during collapse.

FIGS. 1–3, 5, 6, and 9 show the normal unstressed or uncollapsed condition of the energy absorbing modules. In such condition the outer walls of the module segments are smooth and uniformly diverge outwardly. When, however, the front of the apparatus is impacted by a vehicle, the supports 12, beginning with the lead or outermost support 12, will be directed back toward the anchor 24 as shown in FIG. 4. This results in pressurization of the interiors of the energy absorbing modules, which are essentially closed containers.

As shown in FIG. 4, collapse of the energy absorbing modules results in the formation of a plurality of folds at the peripheries of the outer walls of the module segments.

Because of the shape of the energy absorbing modules, the folds do not substantially engage and interfere with one another, allowing the energy absorbing module to collapse in a stroke efficient manner within a relatively short distance. This is to be compared with compression of a closed ended cylinder from end-to-end wherein folds formed in the cylinder would be in direct engagement and interfere with one another, causing undesirable variance in the rate of collapse. Use of the two module segments having outer walls in the form of truncated cones effectively eliminates this problem.

It will be appreciated that a damaged energy absorbing module may be readily removed and replaced after an accident or to substitute modules with different collapse characteristics.

Figure 7:
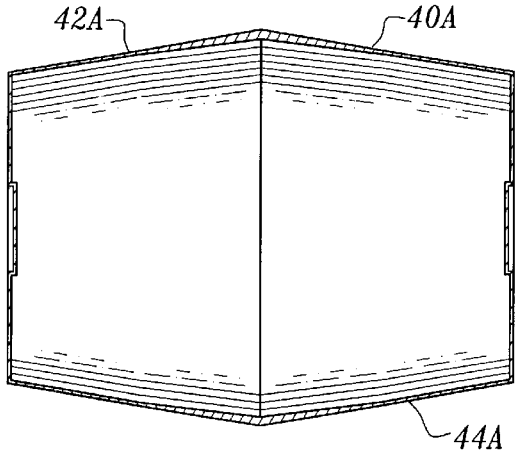
FIG. 7 is a cross-sectional view of an alternative form of energy absorbing module in uncollapsed condition.

FIG. 7 illustrates an alternative embodiment of an energy absorbing module, module 40A. In this embodiment, the interior of the module is not filled with foam but rather is simply filled with air which will compress upon collapse of the module. Another difference is that the outer walls of the module segments 42A and 44A vary in thickness, in this instance being thicker near the junction of the module segments than at the ends of the energy absorbing module. This variation in thickness can be utilized to vary the collapse characteristics of the module.

Figure 8:
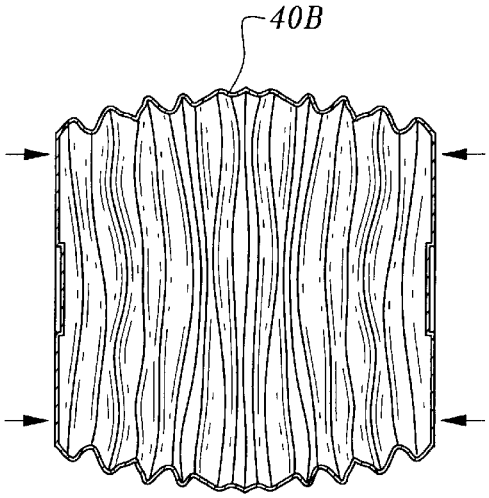
FIG. 8 is a cross-sectional, side, elevational view of another form of energy absorbing module shown in a collapsed state.

FIG. 8 shows another variation of energy absorbing module, module 40B, during collapse. In this embodiment also there is no foam fill, the interior being filled with air which becomes pressurized during collapse. The outer walls of the module segments of the module 40B are of uniform thickness, similar to module 40 described above. FIG. 8 clearly shows the formation of non-interfering folds at the peripheries of the outer walls of the module segments and illustrates the fact that such folds, due to the tapered shape of the outer walls, do not interfere with one another to adversely affect operation of the module when collapsed under the forces caused by vehicle impact. If desired, one or more modules which are not foam filled may be employed in a particular installation with one or more foam filled modules so that some of the modules have different rates of collapse when a predetermined force is applied thereto.

Figure 10:
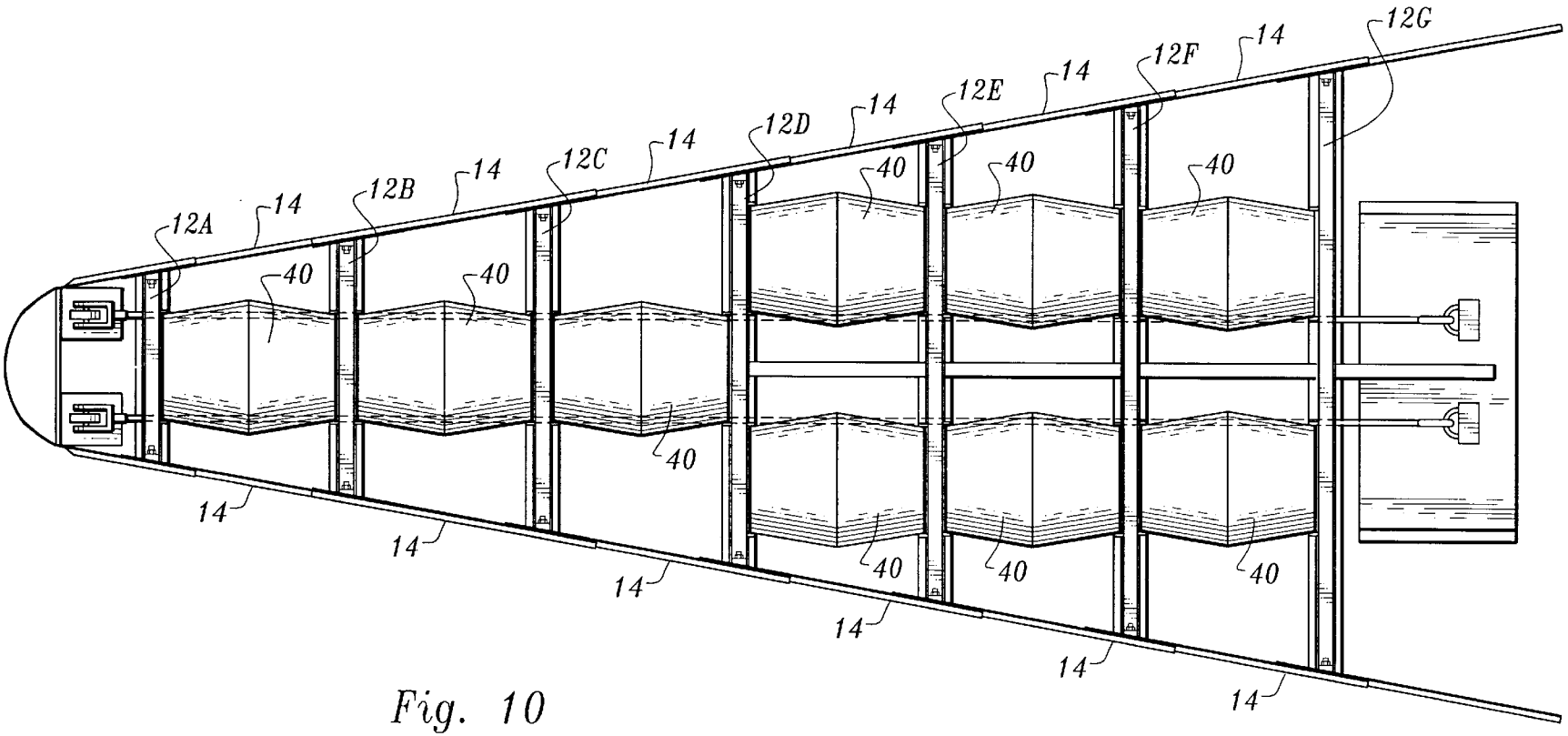
FIG. 10 is a view similar to FIG. 2, but illustrating an alternative form of apparatus.

FIG. 10 shows an embodiment wherein the side panels 14 diverge from front to back to accommodate different lengths of supports 12A–12G. A single row of energy absorbing modules 40 are located between supports 12A–12D and a double row of modules 40 is located between supports 12D and 12G. It will be appreciated that such an arrangement results in progressively greater resistance to an impact crash as the barrier apparatus is reduced in length.

The invention claimed is:

1. Apparatus for absorbing energy when impacted by a vehicle, said apparatus comprising, in combination:

a plurality of vertical, spaced supports; and a double-ended energy absorbing module disposed between adjacent supports of said plurality of vertical, spaced supports collapsible when a force is applied to an end of the energy absorbing module due to relative movement between said adjacent supports caused by a vehicle impacting said apparatus, said energy absorbing module defining an interior and including two attached and aligned module segments, each of said module segments having an end wall and an outer wall substantially in the form of a truncated cone attached to the end wall thereof and extending away from the end wall thereof to the other module segment and diverging outwardly in the direction of the other module segment, the outer walls of said module segments being substantially unpleated when a force is not applied to an end of the energy absorbing module and responsive to collapse of the absorbing module when a force is applied to an end thereof to form a plurality of folds at the peripheries of the outer walls which do not substantially engage or interfere with one another.

2. The apparatus according to claim 1 including a plurality of energy absorbing modules, the end walls thereof being substantially vertically disposed.

3. The apparatus according to claim 1 additionally comprising connector means releasably connecting said energy absorbing module to said adjacent supports to support the energy absorbing module by said adjacent supports.

4. The apparatus according to claim 3 wherein said connector means includes projections projecting from said adjacent supports and disposed under said energy absorbing module.

5. The apparatus according to claim 1 wherein said energy absorbing module is formed from plastic, said module segments being integrally attached and defining said interior.

6. The apparatus according to claim 5 wherein said energy absorbing module is of molded plastic construction.

7. The apparatus according to claim 1 wherein the outer wall of at least one of said module segments varies in thickness.

8. The apparatus according to claim 1 additionally comprising compressible filler material disposed in the interior of said energy absorbing module.

9. The apparatus according to claim 8 wherein said compressible filler material comprises plastic foam.

10. The apparatus according to claim 1 wherein said energy absorbing module defines at least one opening allowing for the egress of air from the interior upon compression of said energy absorbing module and pressurization of said interior.

11. The apparatus according to claim 10 additionally comprising a blow out plug plugging said at least one opening and responsive to a predetermined pressure within said interior to uncover said at least one opening.

12. The apparatus according to claim 1 including a plurality of energy absorbing modules, at least some of said energy absorbing modules having different rates of collapse when a predetermined force is applied thereto.

13. The apparatus according to claim 1 including a plurality of energy absorbing modules disposed in alignment.

14. A double-ended energy absorbing module for positioning between two vertical, spaced supports to absorb energy when a support of said vertical, spaced supports moves toward the other of the supports as a result of vehicle impact, said energy absorbing module defining an interior and including a module segment having an end wall and an outer wall substantially in the form of a truncated cone along substantially the length thereof and extending away from the end wall thereof and diverging outwardly, said outer wall being substantially unpleated when one of the supports does not move toward the other of the supports and the energy absorbing module is in uncollapsed condition and responsive to collapse of the energy absorbing module when one of the supports moves toward the other of the supports to form a plurality of folds at the periphery of the outer wall which do not substantially engage or interfere with one another.

15. The energy absorbing module according to claim 14 wherein the outer wall varies in thickness.

16. The energy absorbing module according to claim 14 defining at least one opening allowing for the egress of air from the interior upon compression of the energy absorbing module and pressurization of said interior.

17. The energy absorbing module according to claim 16 additionally comprising a blow-out plug plugging said at least one opening and responsive to a predetermined pressure within said interior to uncover said at least one opening.

18. The energy absorbing module according to claim 14 comprising two aligned module segments and wherein each of said module segments has an outer wall substantially in the form of a truncated cone and extending away from an end of the energy absorbing module and diverging outwardly in the direction of the other module segment.

19. The energy absorbing module according to claim 18 wherein said module segments are integrally attached, said energy absorbing module being formed of plastic.

20. The energy absorbing module according to claim 19 of molded plastic construction.

21. The energy absorbing module according to claim 18 wherein each of said module segments additionally includes an end wall.

22. The energy absorbing module according to claim 14 additionally comprising compressible filler material disposed in the interior.

23. The energy absorbing module according to claim 22 wherein said compressible filler material comprises foam material.

* * * * *